US007621775B1

(12) United States Patent
Michaud et al.

(10) Patent No.: US 7,621,775 B1
(45) Date of Patent: Nov. 24, 2009

(54) EASY ASSEMBLY AND IMPROVED DESIGN METER SOCKET

(75) Inventors: Alain Michaud, Richelieu (CA); Yves Boucheri, St-Jean-sur-richelieu (CA); Michelle DiLillo, Chambly (CA); Steve Levesque, St-Constant (CA)

(73) Assignee: Thomas & Betts International, Inc., Wilmington, DE (US)

( * ) Notice: Subject to any disclaimer, the term of this patent is extended or adjusted under 35 U.S.C. 154(b) by 0 days.

(21) Appl. No.: 12/384,389

(22) Filed: Apr. 2, 2009

(51) Int. Cl.
*H01R 33/945* (2006.01)

(52) U.S. Cl. ..... 439/517; 439/146; 439/508; 361/688

(58) Field of Classification Search ..... 439/146, 439/508, 517; 361/659, 661–663, 668
See application file for complete search history.

(56) References Cited

U.S. PATENT DOCUMENTS 3,764,956 A * 10/1973 Norden ..... 439/517
5,657,200 A * 8/1997 Leach et al. ..... 361/668
7,106,576 B2 * 9/2006 Schoonover et al. ..... 361/668
7,142,412 B2 * 11/2006 Witherbee et al. ..... 439/517
7,291,042 B2 * 11/2007 Johnson ..... 439/517

* cited by examiner

*Primary Examiner*—Tho D Ta
(74) *Attorney, Agent, or Firm*—Hoffman & Baron, LLP

(57) ABSTRACT

A meter socket base assembly including a mounting block, one or more connectors, one or more meter jaws and, optionally, one or more support blocks. The mounting block has first and second ends, first and second sides, a top, a bottom and a longitudinal axis between the first and second ends and includes a base, first and second walls defining a channel and, optionally, first and second coupling mechanisms. Recessed portions and indentations on the top of the side walls receive connectors at different orientations. Coupling mechanisms can be formed on the exterior sides of the mounting block for attaching support blocks. The meter jaws are attached to the top of the side walls and configured to receive the blade contacts of watthour meters.

31 Claims, 11 Drawing Sheets

EASY ASSEMBLY AND IMPROVED DESIGN METER SOCKET

FIELD OF THE INVENTION

The present invention is a meter socket. In particular, the present invention relates to a meter socket that has a reduced number of components so that it can be easily assembled and disassembled.

BACKGROUND OF INVENTION

In the electric utility industry, plug-in, socket-type watthour meters are commonly used to measure electric power consumption at residential or commercial sites. The most common type is more properly known as a kilowatt hour meter or a joule meter. When used in electricity retailing, the utilities record the values measured by these meters to generate an invoice for the electricity. These meters may also record other variables including the time when the electricity was used.

The socket for the watthour meter is usually installed in a housing that is mounted on a wall of the residence or commercial building. Typically, the housing is transparent or has a window so that the meter can be read without opening the housing. The meter socket contains pairs of line and load terminals which are respectively connected to electric line and load conductors. The terminals receive the blade contacts of a plug-in watthour meter to complete an electric circuit through the meter between the line and load terminals.

Meter sockets having locking jaws for receiving the bayonet or blade contacts of a watt-hour meter are well known. The meter jaws allow a meter to be quickly and easily installed and removed without the use of screws or other fastening devices. The meter opposing sides of the meter jaws are biased towards each other compressively engage the blade contacts of the meter.

Meter sockets are generally located on a panel or in an enclosure having openings in the side and/or end walls for receiving the line cables and the load cables. When the meter socket is mounted in an enclosure, it is typically mounted to a panel attached to the back wall of the enclosure. The enclosure has a removable front cover or door with an opening for receiving the dome portion of the meter, which extends therethrough when installed in the meter socket.

The meter socket generally includes four or six jaw-type terminals for receiving the blade contacts of the meter. As discussed in U.S. Pat. No. 3,281,550 to Waldrop, some meter sockets can also include bypass conductor members that are used to short the line and load contact of the same phase by operation of a lever. In this particular instance, the bypass conductor members are moved to an open position by placing an insulative material against the bypass member to move the cantilevered bypass member out of electrical contact with the load side jaw-type terminals.

A meter for measuring the usage of electricity is coupled to a plurality of bus members or lines at a meter socket. The meter socket includes a non-conductive base formed by one or more members, a plurality of lugs for connecting the bus lines, a plurality of pincer-like jaw assemblies (also referred to herein as a "meter jaw"), and a base bracket. Typically, the base bracket is attached to a grounding/support structure and the non-conductive base is attached to the base bracket. The lugs are attached to the non-conductive base member(s) and each of the jaw assemblies is connected to a lug. Thus, each jaw assembly is in electrical communication with either the line or the load bus. The jaw assembly openings face away from the front of the meter socket to allow easy insertion of the bayonet connectors (also referred to herein as blade connectors) of the meter. The meter typically includes a cylindrically-shaped enclosure containing a metering device with the meter display on the front side and a plurality of bayonet connectors extending from the back side. The bayonet connectors are adapted to be received by the jaw assemblies to electrically connect the line and load buses through the meter. The metering device collects data relating to electrical usage based on the amount of electricity passing through the meter.

The meter sockets that are currently in use ("the old types" or "prior art")) are generally assemblies that include two mounting blocks attached to a steel support bridge, two stand-alone support blocks, a plurality of jaw assemblies and connectors and a plurality of screws, connectors and/or fasteners. Typically, these meter socket assemblies use two different types of connectors (45-degrees or 90-degrees depending of construction type) for the line and load connections. Moreover, these prior art designs with their numerous components and fasteners require a considerable amount of assembly time.

The old types of meter sockets typically have rectangular spacers that receive the meter jaw assemblies. These spacers fit into rectangular holes in the block and tend to slide from side-to-side. When a cable is installed in the cable receiving port and torque is applied to the retaining screw, a force is transferred to the body of the connector that causes the connector to move away from the block wall and can damage the block.

In addition, the two "old types" of connectors typically require three holes through the planar portion; one hole for receiving the jaws assembly and two holes that corresponded to dimples on the block. These additional two holes reduce the cross-section of the connector (i.e., the amount of material in the connector), which is carrying electrical current. The reduced cross-section means that the same amount of electricity must be carried by less conductive material, which is less efficient and increases the temperature of the connector.

The prior art meter socket described above, as well as other well known meter sockets, suffers a variety of disadvantages. Accordingly, there is a need for a meter socket with unitary construction (i.e., a "mono-block" or a "uni-block") that doesn't use a steel bridge to connect the two mounting blocks and doesn't require fasteners or screws to attach the stand-alone support blocks. There is also a need for a meter socket that is designed to receive a jaws assembly so that it does not slide when the retaining screws are torqued to secure the line and load cables.

There is also a need for a meter socket that can use connectors for the line and load connections that only require one hole so that they will more efficiently conduct electricity and operate at a lower temperature. There is also a need for a meter socket that can use a single connector to make connections of 45° or 90° with respect to the centerline of the meter socket.

The present invention is directed to overcoming each of the disadvantages set forth above as well as other disadvantages not specifically described herein but which will become readily apparent to those of ordinary skill in the art in view of the detailed description of the present invention.

Thus, it would be desirable to provide a watthour meter socket that has a simplified construction, uses fewer components and requires fewer manufacturing steps. It would also be desirable to provide a watthour meter socket adapter with stand-alone support blocks that can be attached without screws or fasteners. It would also be desirable to provide a watthour meter socket adapter designed to fixedly receive a jaws assembly so that it stayed in position when the connector retaining screws are tightened. It would also be desirable to provide a watthour meter socket adapter having a connector that has only one hole for increased efficiency and that can be mounted to the meter socket mounting block at different angles.

SUMMARY OF THE INVENTION

In accordance with the present invention, a meter socket base assembly is provided. The meter socket base assembly includes a mounting block, one or more connectors, one or more meter jaws and, optionally, at least one support block. The mounting block includes a base, first and second walls, a channel and, optionally, first and second coupling mechanisms. Preferably, the mounting block and the support blocks are formed from electrically non-conductive material. The meter socket base assembly can also include a connector for connecting a neutral conductor.

The base has first and second ends, first and second sides, a top, a bottom and a longitudinal axis between the first and second ends. The first and second walls extend from the top of the base on the first and second sides and are substantially parallel. Each wall has a top surface, a pair of opposing ends and interior and exterior sides. The top surface at each opposing end has a recessed portion with one or more indentations and at least one substantially round opening (also referred to herein as an aperture) extending through the top surface. The one or more indentations in the recessed portion of the block can be slots. Preferably, there are at least a first slot extending substantially perpendicular to the longitudinal axis of the base and a second slot extending at about a 45-degree angle to the longitudinal axis. Preferably, at least the opposing ends of the first and second walls of the mounting block are hollow.

The channel has a bottom formed by the top surface of the base that is disposed between the interior sides of the first and second walls and extends between the first and second ends of the base. The channel can be adapted to receive an insulated neutral conductor. The channel can also include one or more apertures in the bottom. These apertures are adapted for receiving a screw to attach the mounting block to a surface.

The optional first and second coupling mechanisms of the mounting block are formed in or on the exterior side of the first and second walls, respectively. The coupling mechanisms can include one or more slots and/or apertures in the side wall or one or more rails and/or members extending from the exterior side of the wall.

Each of the one or more connectors is constructed of electrically conductive material and has a substantially planar body with a first end, a mid-portion and a second end. The first end has a cable receiving port and retaining screw for connecting a cable, the mid-portion has an aperture and the second end has a member that extends substantially perpendicular to the body. The member is adapted to be received by one of the indentations in one of the recessed portions. Preferably, the member is a lip that extends along the second end of the connector and the indentation is a slot. For most applications, the meter socket base assembly requires two or four connectors.

Each of the one or more meter jaws is constructed of electrically conductive material and has a first end adapted to receive a blade contact of a meter (preferably a watthour meter) and a second end with an aperture adapted for attachment of the meter jaw to one of the connectors and the mounting block. A fastening device, preferably a threaded member such as a screw or bolt and a nut, can be attached to the second end of one of the meter jaws through one of the hollow ends of one of the mounting block walls to secure the meter jaw to the mounting block.

The meter socket base assembly can also include at least one threaded member, at least one spacer and at least one nut. The spacer is preferably cylindrically-shaped and about equal in length to the thickness of recessed portion of the mounting block. The spacer is inserted the opening in one of the recessed portions and then the threaded member is sequentially inserted through the spacer, the aperture in one of the connectors and the aperture in one of the meter jaws. The nut is then threaded onto the threaded member to secure the connector and the meter jaw to the mounting block. Each of the connectors can also include a retaining screw adapted to secure a cable in the cable receiving port. When the retaining screw is tightened to retain a cable in the port, the spacer is adapted to transfer the force created by tightening the retaining screw from the first end of the body to the member on the second end. The member then transfers the force to the indentations or slot in the recessed portion.

Each of the support blocks includes an electrical terminal and has a top, a bottom, a pair of sides, a pair of ends and a coupling mechanism. The electrical terminal on the support block is connected to one of the meter jaws on the mounting block by an electrical conductor, preferably an electrical strap or buss. The support blocks can also include one or more apertures that are adapted for receiving a screw to attach the support block to a surface. The coupling mechanism is adapted to be coupled with one of the coupling mechanisms on the mounting block to attach the support block to the mounting block. The coupling mechanism can include one or more slots and/or apertures in the sides or one or more rails and/or members extending from one of the sides.

The coupling mechanisms on the walls of the mounting block and on the side of the support block are correspondingly located so that the one or more rails on one of the blocks engages the one or more slots on the other block or the one or more members on one of the blocks engages the one or more apertures on the other block. Other types of coupling mechanisms can be used and are within the scope of the invention, including coupling mechanism that slide and/or snap together to couple the support block to the mounting block.

BRIEF DESCRIPTION OF THE FIGURES

The preferred embodiments of the meter socket assembly of the present invention, as well as other objects, features and advantages of this invention, will be apparent from the accompanying drawings wherein.

DETAILED DESCRIPTION OF THE INVENTION

Figure 1:
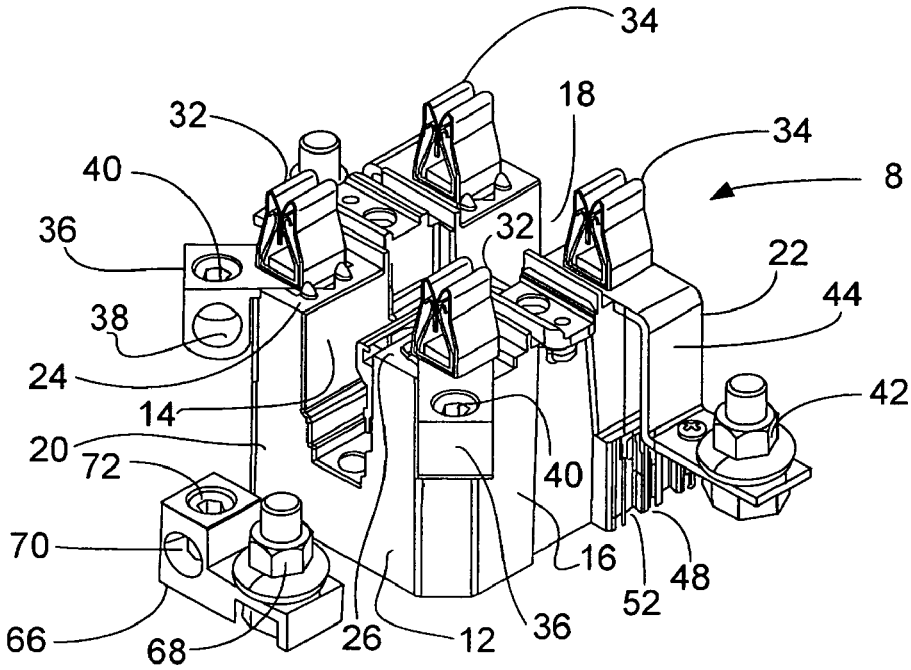
FIG. 1 is a top perspective view of an embodiment of the meter socket assembly of the present invention.

The present invention is a meter socket base assembly that can be used with meters, preferably watthour meters, in applications of up to 200 amps. The mounting block portion of the assembly is constructed from a single block, i.e., a "mono-block" that replaces the prior art designs that had two separate mounting blocks connected by a metal bridge. The "mono-block" design requires fewer components, is faster to assemble, and performs better. The "mono-block" and connectors are designed so that the connectors can be installed in two different orientations (45-degrees or 90-degrees) and provide better resistance to the forces applied when the connectors are tightened. In addition, the "mono-block" is constructed from non-electrically conductive materials, preferably a plastic or nylon material, which improves the dielectric insulation.

The mono-block construction can be used for meter socket assemblies designed for applications up to about 200 amps. By constructing the support block of the meter socket assembly as a unitary structure, the mono-block design reduces the number of components and eliminates the need for a steel mounting bridge. As a result, the meter socket assembly has one mounting block instead of two and two screw fasteners instead of eight (for attaching the mounting block(s) and support blocks to a surface). This reduces assembly time. In addition, the connections for the mono-block design are configured so that the line and load connectors are separated by a greater distance from grounded metal parts, which results in a higher dielectric insulation performance.

The mono-block has recessed portions of the surface (also referred to as pockets) that are adapted for receiving the line and load connectors at the four corners on the top surface. These recessed portions (i.e., pockets) have at least one aperture through which a fastening device is inserted for securing the connector and a meter jaw to the mono-block. The dimensions of the pockets are designed so that the connectors can be oriented and installed at angles of either 45- or 90-degrees from the longitudinal axis of the support block. In previous designs, two different types of connectors were required, one for the 45-degree position, and the other for the 90-degree position. The pockets are defined in the top surface of the mono-block by a wall having a plurality of sections. Indentations or slots in the pockets extend along at least two of these wall sections for receiving the lip of a connector, as explained in more detail below.

The meter socket assembly is designed so that the mounting block can be used without support blocks. However, the mono-block design enables the user to easily attach support blocks to the mounting block at any time, even after the mounting block is installed in an enclosure. The user simply loosens the three screws that secure the mounting block to the back wall of an enclosure and slide the support block and mounting block together using the coupling mechanisms. The three screws on the mounting block and a fourth screw on the support block are then tightened to complete the installation. The coupling mechanisms on the mounting block and the support blocks are not attached using screws and, thus, up to four screw fasteners are eliminated from the final assembly.

If an insulated neutral is required for the meter socket assembly, it needs to be mounted in a position not far from the line and load connectors. The mono-block design allows the neutral termination to be installed in the center of the mono-block, in between the line and load connectors. This is the position of the neutral preferred by most end-users. In previous designs, an insulated neutral had to be installed on the side or the top of the block assembly, further away from the line/load connectors.

The connectors and meter jaws are attached to the mono-block using a fastener, preferably a threaded member such as a screw or a bolt and a nut. Prior to installing the fastener, a substantially round spacer is inserted into the aperture in the recessed portion of the mono-block. The spacer is preferably made from a metal such as steel and can be shaped like a washer, a cylinder or a tube with an outer diameter sized to snugly fit into the aperture and an inner diameter sized to snugly receive the fastener. The spacer is designed so that it can freely rotate in the aperture and the fastener can freely rotate inside the spacer. In another embodiment, the spacer can have a cylindrical body with a flanged end. The cylindrical body snugly fits in the aperture and the flanged end has a diameter larger than the diameter of the aperture, which prevents the spacer from passing through the aperture. When a spacer with a flanged end is used, it is installed in the aperture from the back side or bottom of the mono-block. After the spacer is installed, the screw or bolt is inserted through the spacer from the bottom and then through an aperture in the connector and an aperture in the base of the meter jaw. A nut is then threaded onto the screw or bolt and tightened to secure the connector and the meter jaw to the mono-block.

When the retaining screw of the connector is tightened to hold a wire or cable in the connector, the torque applied to tighten the retaining screw is transferred to the body of the connector. As used herein, the term torque refers to the rotational force created along the longitudinal axis of the retaining screw when the screw is tighten to secure a cable in the cable receiving port of a connector. This rotational force is transferred to the body of the connector as a planar force. The design of the spacer permits only axial movement so that the connector pivots on the spacer and threaded member securing the connector to the block and transfers the force to the other end of the connector, which abuts against the side wall and is secured in the indentation or slot in the pocket. The connector for the meter socket assembly also has an extending member, such as a tab, a prong or a lip, which fits into an indentation, preferably a slot, in the mono-block. This provides an increased resistance and absorbs the torque applied to the connectors when the retaining screw is tightened. This design eliminates the need for dimples on the mono-block and holes on the connector so that the connector has a full cross-section, which reduces the increase in the temperature of the connector when it is in operation.

Figure 2:
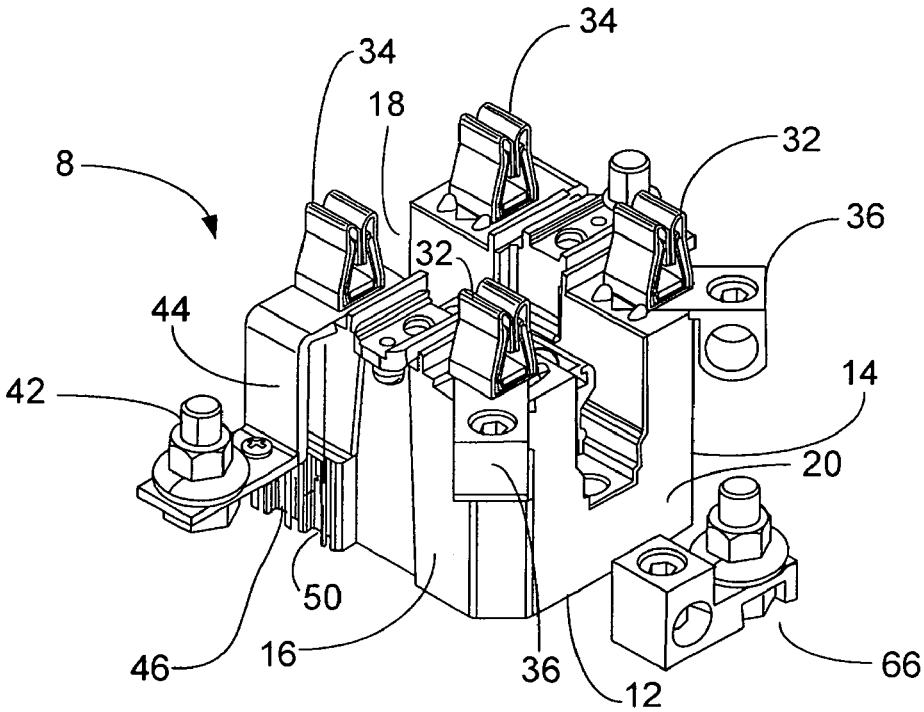
FIG. 2 is a top perspective view of the meter socket assembly shown in FIG. 1 rotated 90-degrees.

Turning now to the drawings, FIGS. 1-8 show different views of an embodiment of the meter socket assembly 8 of the present invention. FIGS. 1 and 2 show a meter socket assembly 8 that includes a mounting block 10 (also referred to herein as the meter socket or mono-block) having a base 12 and two opposing side walls 14, 16 extending from the base 12 to define a channel 18. The channel 18 extends between the opposing ends 20, 22 of the mounting block 10 and is substantially parallel to the longitudinal axis of the mounting block 10. Each of the side walls 14, 16 has a top surface 24, 26, respectively, with openings 28, 30, respectively. (The openings 28, 30 are concealed in FIGS. 1-8 but are shown in FIG. 9.)

The openings 28, 30 at the ends 20, 22 of the side walls 14, 16 are used to secure two pairs of meter jaws 32, 34 to the mounting block 10. The meter jaws 32, 34 are adapted to receive the blade contacts of a meter (not shown). For one pair of meter jaws 32, each meter jaw 32 is connected to a connector 36, which receives a wire or cable (not shown) in a port 38 and then secures the wire or cable in the connector 36 by tightening a retaining screw 40. Each of the other pair of meter jaws 34 is connected to a terminal 42 by an electrical conductor 44.

Figure 15:
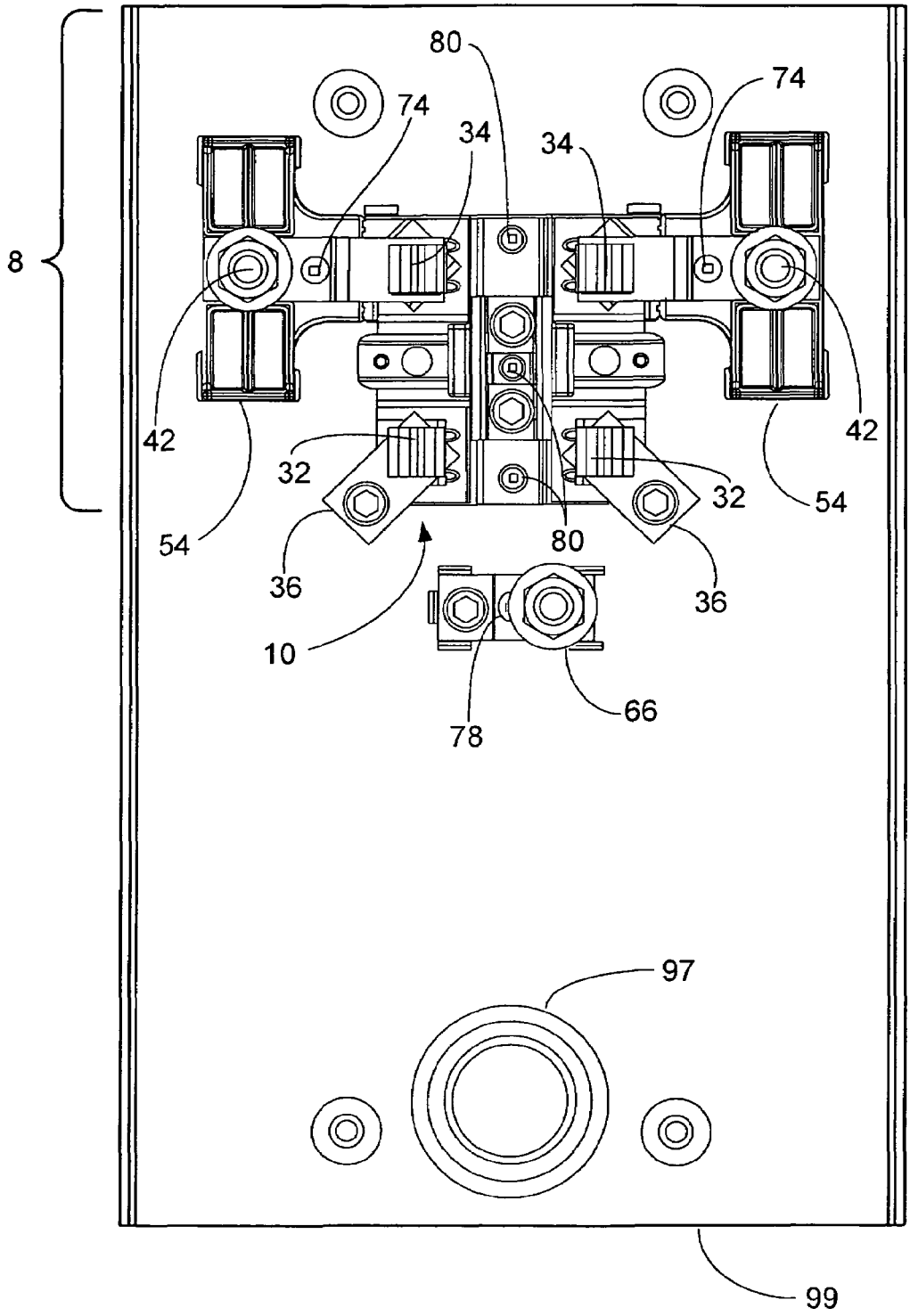
FIG. 15 is a top view of a meter socket assembly installed in an enclosure.

The side walls 14, 16 have coupling mechanisms 46, 48 formed by a plurality of slots 50, 52, respectively, that extend upwardly from the base 12. As described in more detail below, the coupling mechanisms 46, 48 are used to connect support blocks 54 (FIG. 10) to the mounting block 10. The top surface 56 of the support block 54 provides support for the terminals 42 (FIG. 13) and the bottom of the support blocks 54 are attached to a surface; typically, the back wall of an enclosure (FIG. 15). One side 60 of the support block 54 has a coupling mechanism 62 formed by a plurality of rails 64 which engage the slots 50, 52 on the mounting block 10.

The meter socket assembly 8 also includes a connector 66 for a neutral conductor (not shown). The connector 66 has a terminal 68 for securing a lug or spade-type connector and an aperture 70 for receiving a wire or cable (not shown) and a retaining screw 72 for securing the wire or cable in the connector 66. The neutral conductor is typically used in a 3-wire service.

Figure 3:
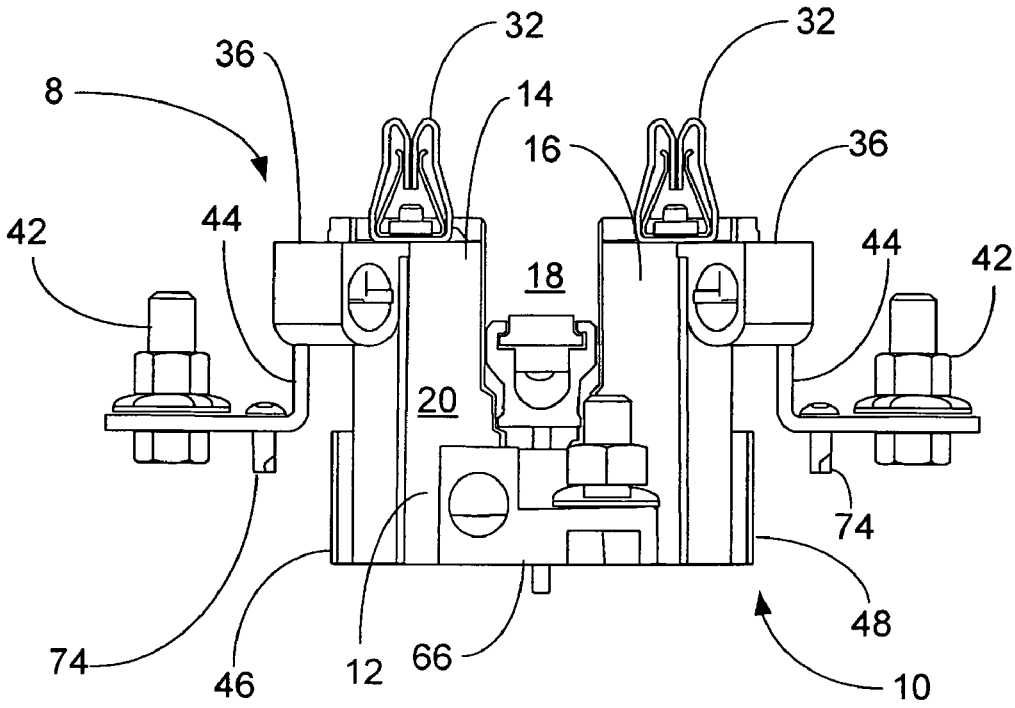
FIG. 3 is an end view of the meter socket assembly shown in FIG. 1.

FIG. 3 shows an end view of the meter socket assembly 8 and illustrates how the channel 18 is formed by the two side walls 14, 16 extending from the base 12. FIG. 3 also illustrates how the coupling mechanisms 46, 48 extend from the opposing side walls 14, 16 near the base 12. The electrical conductors 44 connecting the terminals 42 have apertures (not shown) which receive mounting screws 74. These mounting screws 74 are used to secure the electrical conductors 44 to the support blocks 54.

Figure 4:
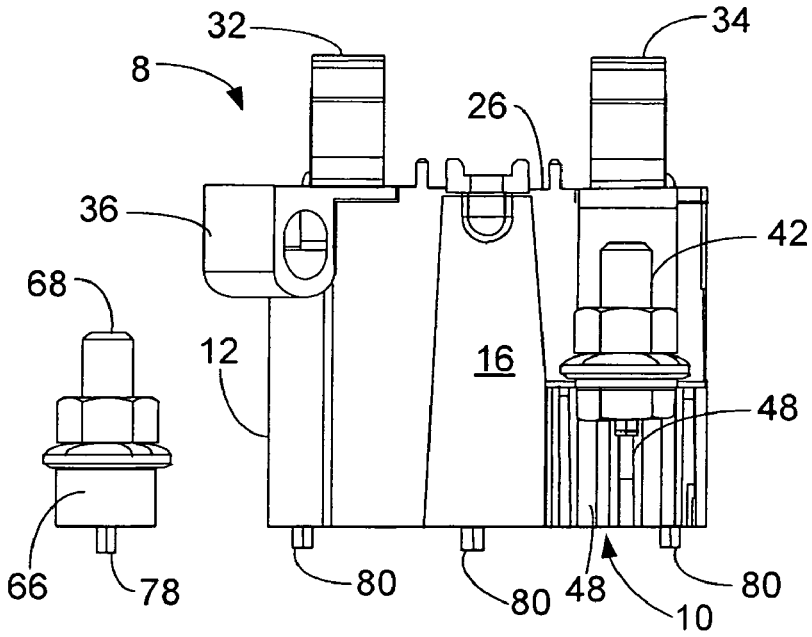
FIG. 4 is a side view of the meter socket assembly shown in FIG. 1.
Figure 5:
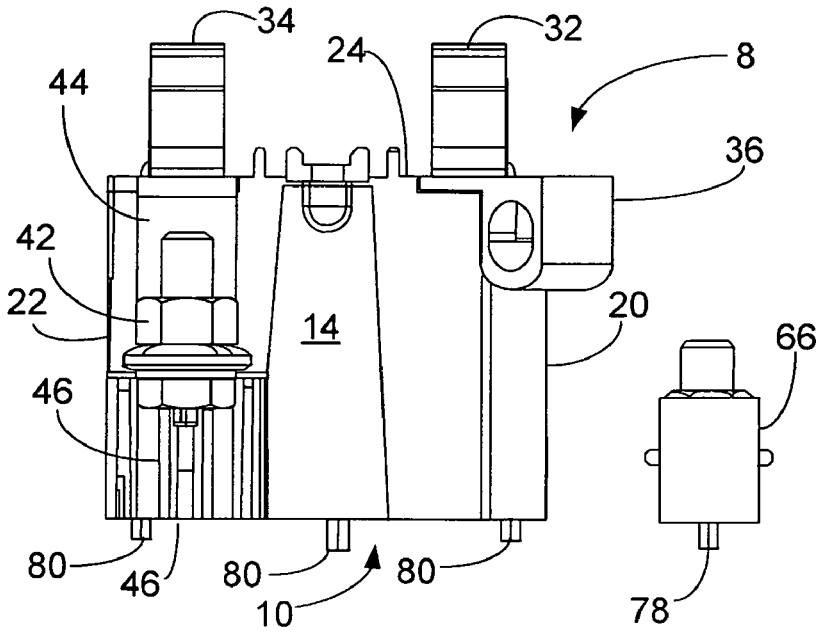
FIG. 5 is a view of the opposite side of the meter socket assembly shown in FIG. 4.

FIGS. 4 and 5 are views of the opposing sides 14, 16 of the meter socket assembly 8 and show a plurality of mounting screws 80 extending through an aperture 82 (FIG. 7) in the base 12. These mounting screws 80 are used to secure the mounting block 10 to a flat surface. Typically, the mounting screws 80 correspond to tapped openings in the back wall of an enclosure (FIG. 15) and are used to secure the mounting block 10 to the back wall. Similarly, connector 66 has a mounting screw 78 that is used to attach the connector 66 to a flat surface, such as the back wall of an enclosure.

Figure 6:
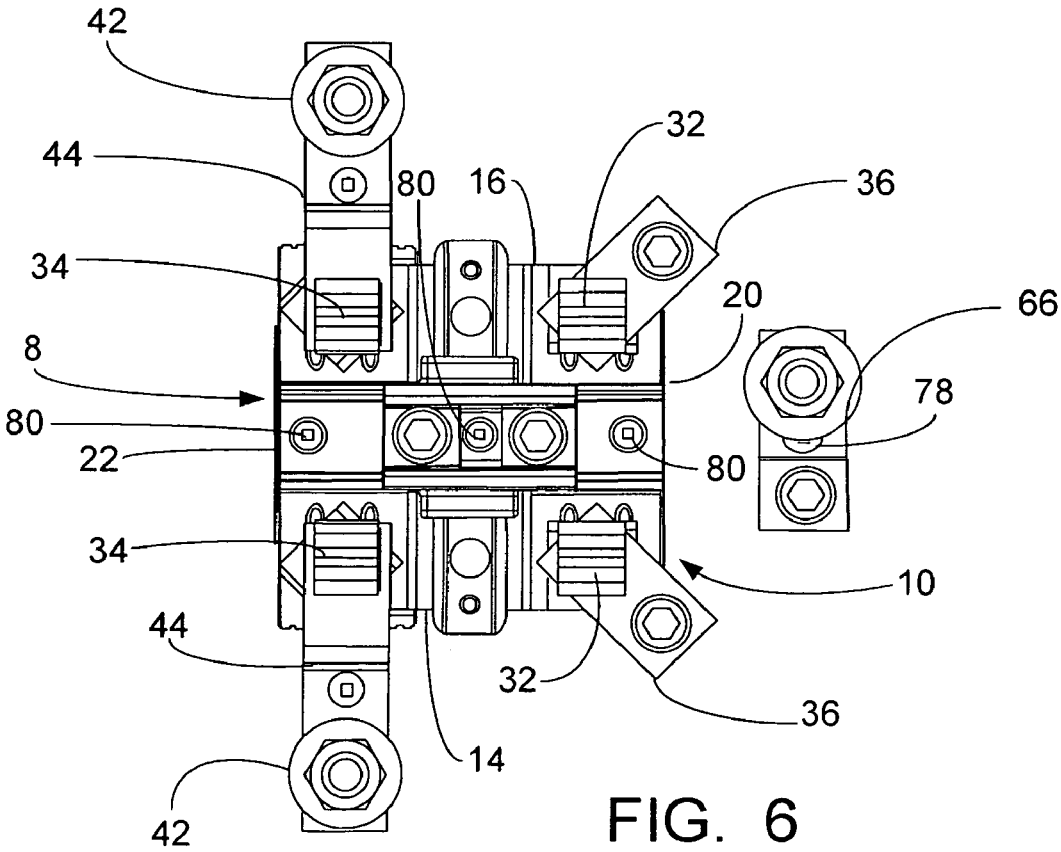
FIG. 6 is a top view of the meter socket assembly shown in FIG. 1.

FIG. 6 is a top view of the meter socket assembly 8 and shows the configuration and orientation of the connectors 36, 42. The blade contacts of the meter (not shown) are received by the meter jaws 32, 34 and the line connections 36, 42 are made on one side of the mounting block 10 and the load connections 36, 42 are made on the other side of the mounting block 10. The mounting block 10 is symmetrical so the user has the choice of making the line and load connections on either side.

Figure 7:
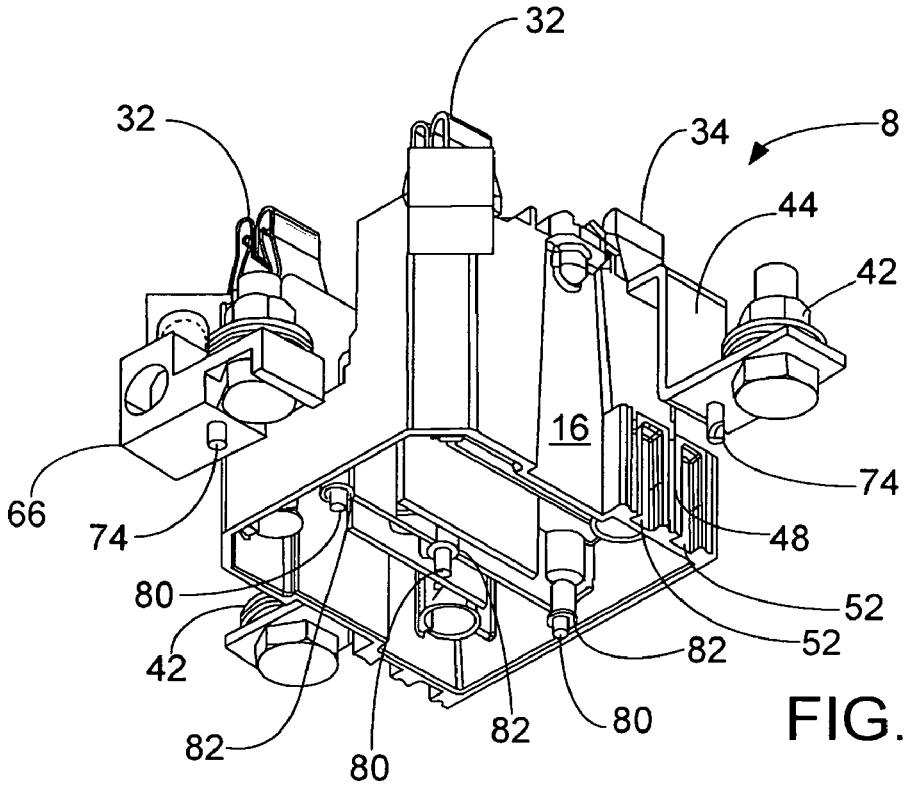
FIG. 7 is a bottom perspective view of the meter socket assembly shown in FIG. 1.
Figure 8:
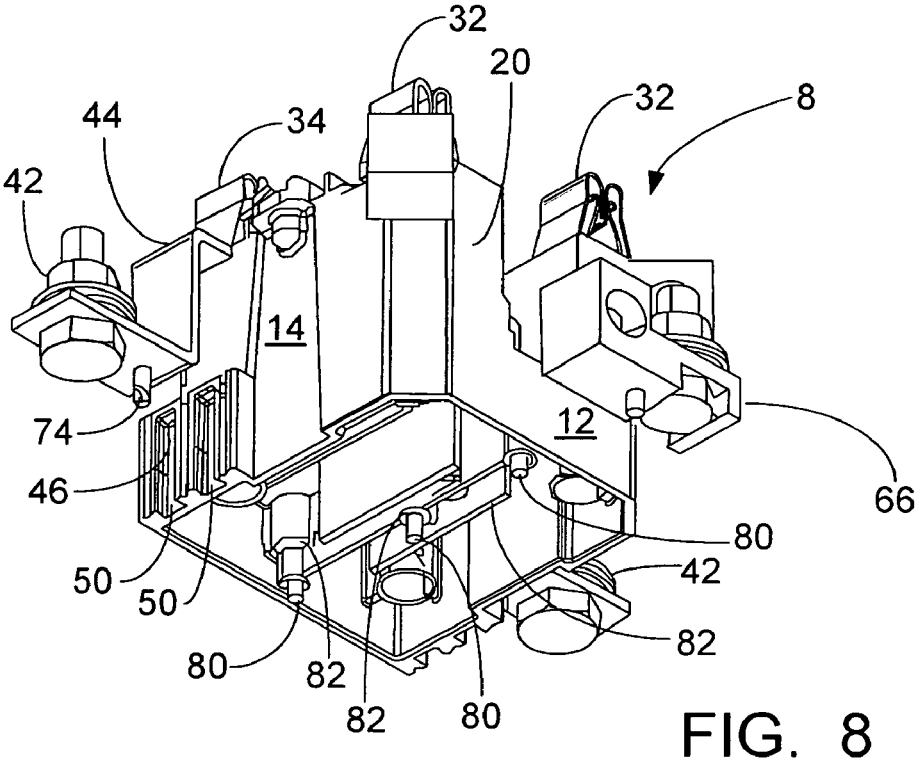
FIG. 8 is a bottom perspective view of the meter socket assembly shown in FIG. 2.
Figure 9:
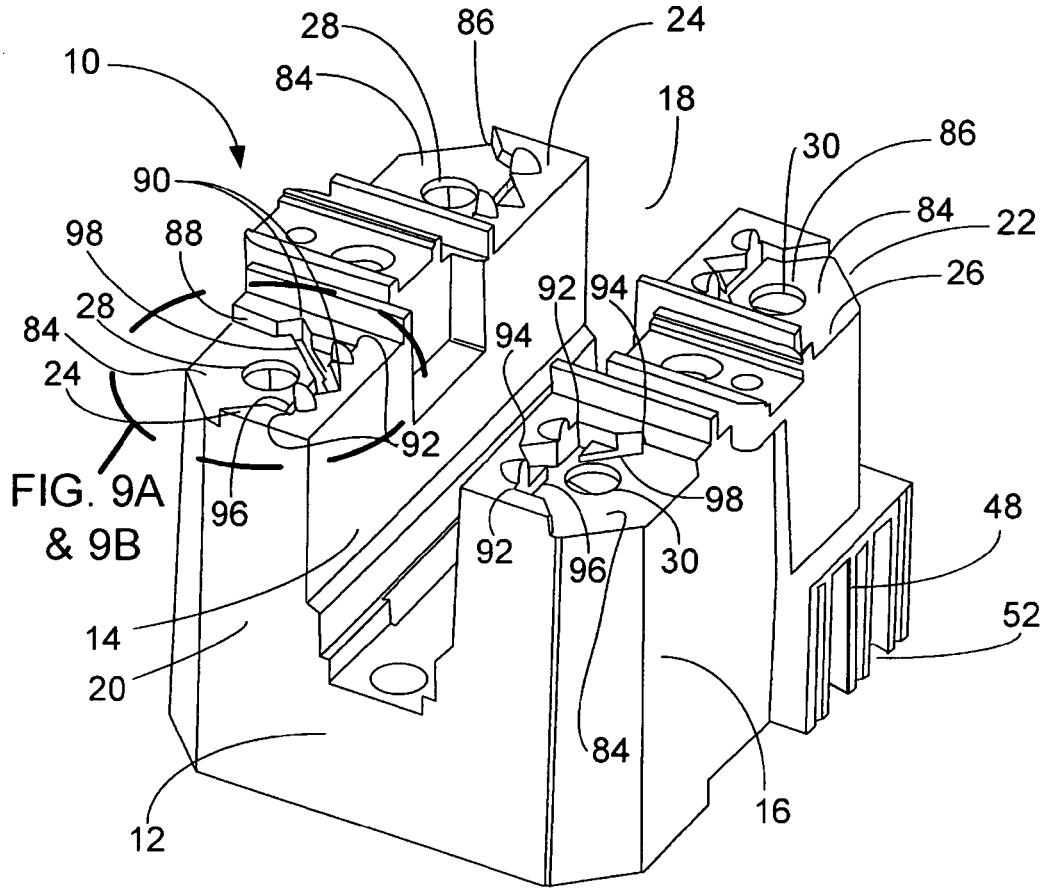
FIG. 9 is a top perspective view of an embodiment of a mounting block of the meter socket assembly of the present invention.

FIGS. 7 and 8 are bottom perspective views of the meter socket assembly 8 shown in FIG. 1. In this embodiment, the mounting block 10 is substantially hollow, which allows fasteners (FIG. 13A) to be attached to the meter jaws 32, 34 to secure them to the mounting block 10. FIGS. 7 and 8 also show how the coupling mechanisms 46, 48 are formed by a plurality of slots 50, 52, respectively, that have an open end at the bottom edge of the side wall 14, 16 and a closed end at the top of the slot 50, 52. Mounting screws 80 extend through apertures 82 in the mounting block 10 and are used to secure the mounting block 10 to a surface.

FIG. 9 shows mounting block 10 without any connectors attached. The four corners 84 on the top surfaces 24, 26 of the side walls 14, 16 have recessed portions 86 that can receive either connectors 32, 34 or electrical conductors 44 (FIG. 1). The recessed portions 86 extend inwardly from the sides 14, 16 and ends 20, 22 of the mounting block 10 and define a wall 88 with a plurality of sections 90. FIG. 9 illustrates the one-piece construction of the mounting block 10 with the two walls 14, 16 extending upwardly from the base 12 to define the channel 18.

Figure 9A:
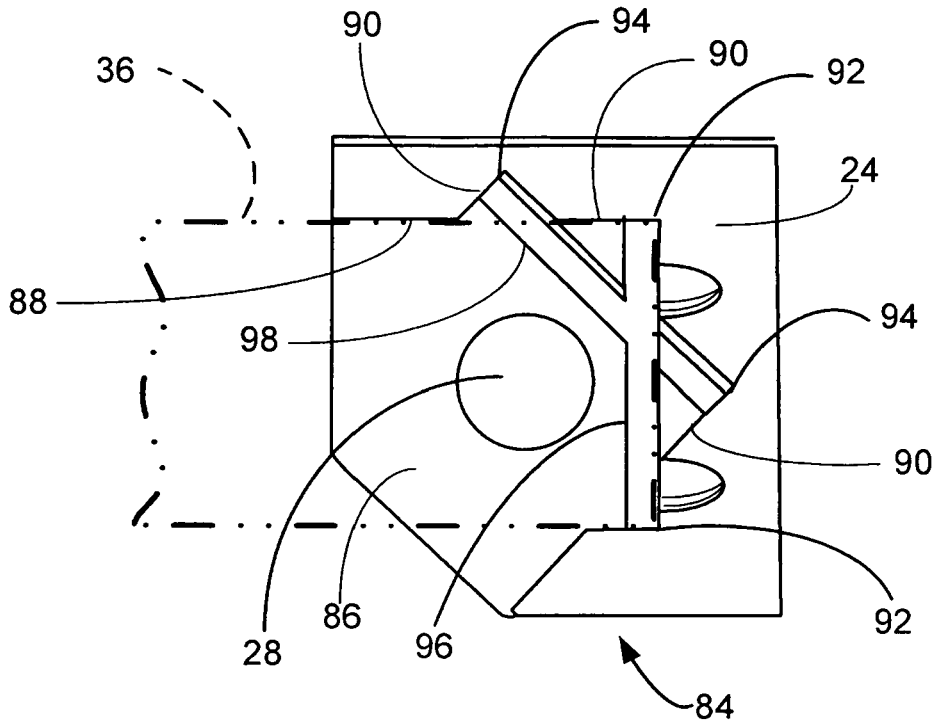
FIGS. 9A and 9B are details of top surface of the corners of the opposing walls of the mounting block shown in FIG. 9.
Figure 9B:
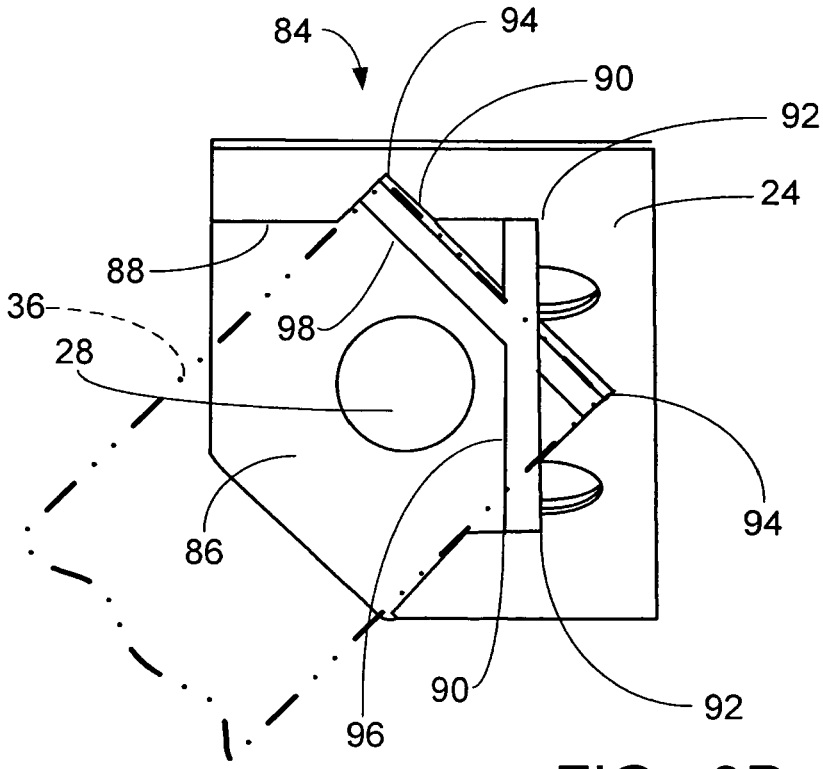

FIGS. 9A and 9B show details of the top surface 24 of one of the corners 84 of the mounting block 10. The other three corners 84 of the mounting block 10 are the same. The top surface 24 has a recessed portion 86 that is defined by a wall 88 formed by a plurality of wall sections 90, which define two pairs of approximately 90-degree corners 92, 94 with slots 96, 98, respectively, in the recessed portions 86 extending between the corners 92, 94. The recessed portion 86 in combination with the corners 92, 94 and the slots 96, 98 are adapted to receive a connector 36 (FIG. 6). One of the slots 96 extends substantially parallel to the channel 18 and the other slot 98 extends at an angle of about 45-degrees with respect to the channel 18 (FIG. 9). The lip 39 of the connector 36 (FIG. 11) is inserted in one of the slots 96, 98 to orient the connector 36 at an angle of either 45-degrees or 90-degrees with respect to the channel 18. FIG. 9A illustrates how a connector 36 with the lip 39 installed in slot 96 extends outwardly from the mounting block 10 at an angle of about 90-degrees. FIG. 9B illustrates how a connector 36 with the lip 39 installed in slot 98 extends outwardly from the mounting block 10 at an angle of about 45-degrees. In both configurations, an opening 28 in the recessed portion 86 is adapted to receive a threaded member that passes through an aperture 37 in the connector 36 and secures a meter jaw 32 to the mounting block 10 (FIG. 1).

Figure 10:
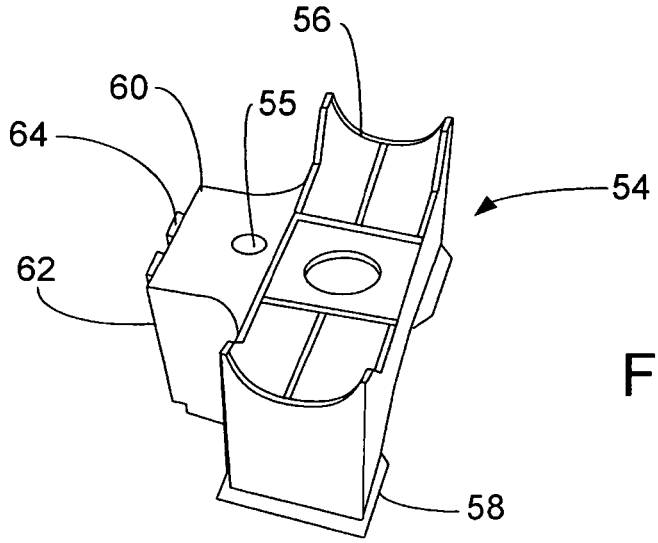
FIG. 10 is a top perspective view of an embodiment of a support block of the meter socket assembly of the present invention.
Figure 13:
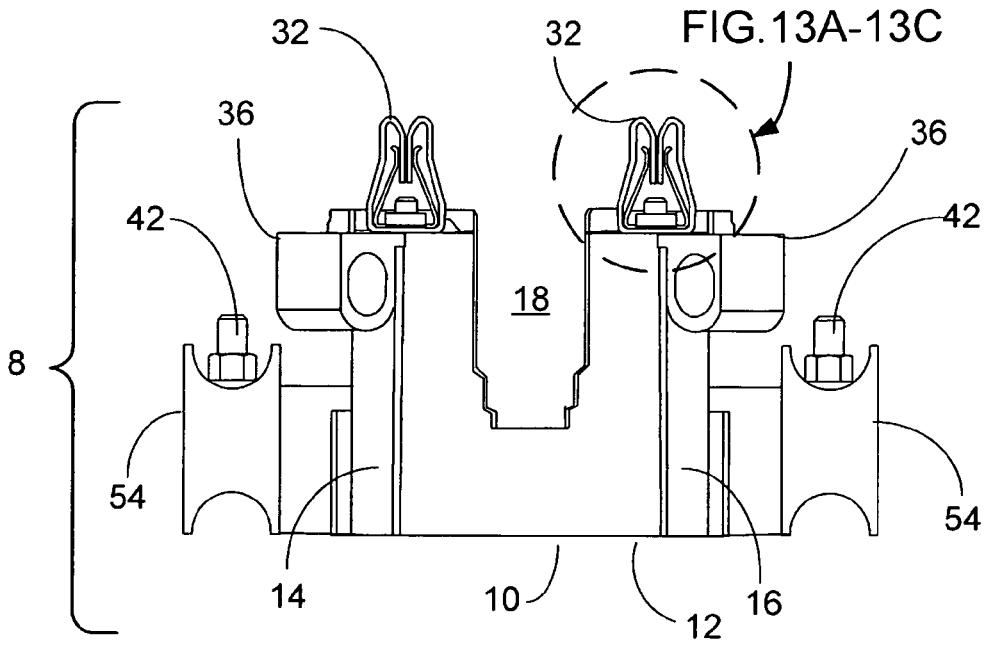
FIG. 13 is an end view of an embodiment of the meter socket assembly of the present invention with support blocks attached to both sides of the mounting block.

FIG. 10 shows a support block 54 that is used to support a terminal 42 on its top surface 56 (FIG. 13). The support block 54 has a coupling mechanism 62 on one side 60 that is formed by a plurality of rails 64. The rails 64 on the support block 54 are inserted into the tracks 50, 52 of the coupling mechanisms 46, 48 on the mounting block 10 and slide up the tracks 50, 52 until they reach the closed end. A mounting screw (not shown) is inserted in an aperture 55 in the top surface 56 of the support block 54 to secure it to a surface (see FIG. 15).

Figure 11:
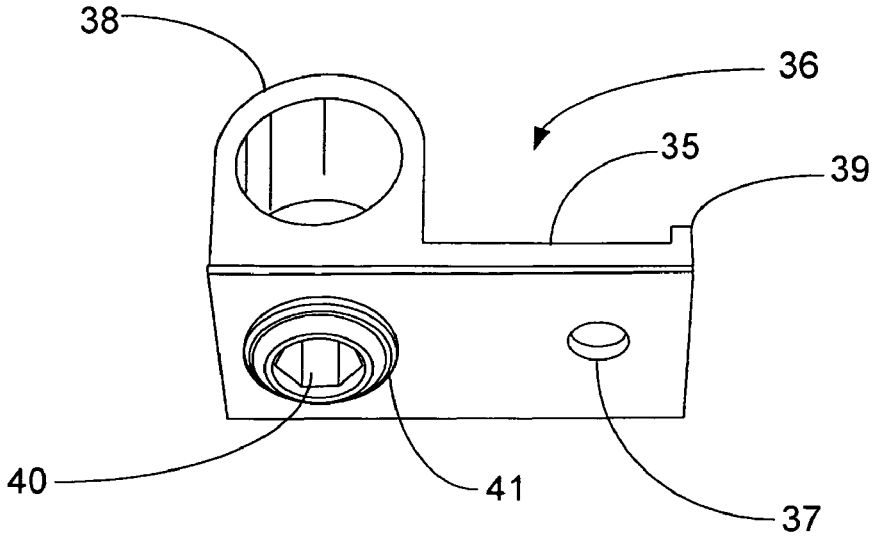
FIG. 11 is a bottom perspective view of an embodiment of a connector of the meter socket assembly of the present invention.

FIG. 11 shows a connector 36 for the meter socket assembly 8, which is attached to the mounting block 10 and one of the meter jaws 32 (FIG. 1). The connector 36 has a substantially flat, rectangular body 35 with a cable receiving port 38 on one end and an aperture 37 for receiving the threaded member 31 of a meter jaw 32 (FIG. 12) on the other end. The cable receiving port 38 extends from one surface of the body 35 and a threaded aperture 41 provides communication between the port 38 and the other side of the body 35. After a cable (not shown) is inserted into the port 38, a retaining screw 40 is threaded into the threaded aperture 41 to hold the cable in the port 38. The end of the body 35 opposite the cable receiving port 38 also has a lip 39 extending substantially perpendicular to the body 35 on the same side of the body as the port 38. This lip 39 is inserted into one of the slots 96, 98 in the recessed portions 86 of the mounting block 10. When the lip 39 is inserted in slot 96, the connector 36 extends substantially perpendicularly from the channel 18 (FIG. 9A). When the lip 39 is inserted in slot 98, the connector 36 extends substantially away from the mounting block 10 at an angle of about 45-degrees from the centerline of the channel 18 (FIG. 9B).

Figure 12:
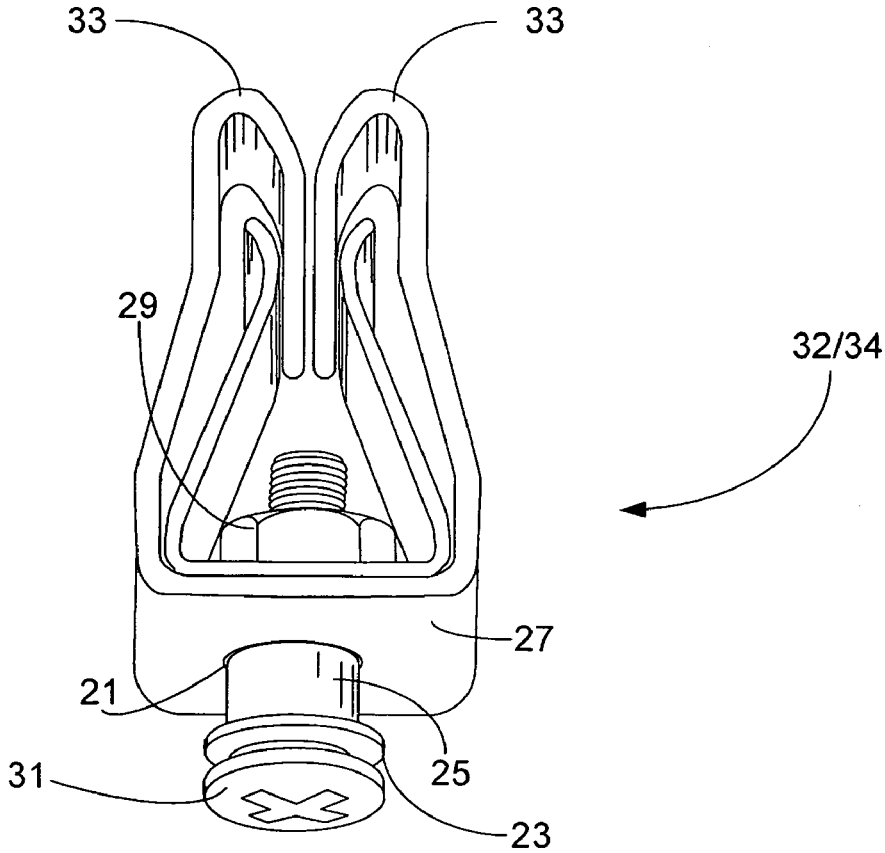
FIG. 12 is a bottom perspective view of an embodiment of one of the meter jaws of the meter socket assembly of the present invention.

FIG. 12 shows a meter jaw 32 or 34 that has opposing jaws 33 for receiving a blade contact of a meter (not shown). The meter jaw 32/34 has a threaded member 31 that is inserted through an aperture 21 in the base 27 of the meter jaw 32/34 and engaged by a nut 29 on the opposite side to attach the meter jaw 32/34 to a structure. When the meter jaw 32 is used with a connector 36, the threaded member 31 is inserted through an opening 28, 30 in the recessed portion 86 from inside the mounting block 10 and then through the aperture 37 in the connector 36 (FIG. 11) to secure both the meter jaw 32 and the connector 36 to the mounting block 10 (FIG. 1). Similarly, when the meter jaw 34 is used with an electrical conductor 44, the threaded member 31 is inserted from inside the mounting block 10 through an opening 28, 30 and then through an aperture (not shown) in the electrical conductor 44 to secure the meter jaw 34 and the conductor 44 to the mounting block (FIG. 1).

Figure 14:
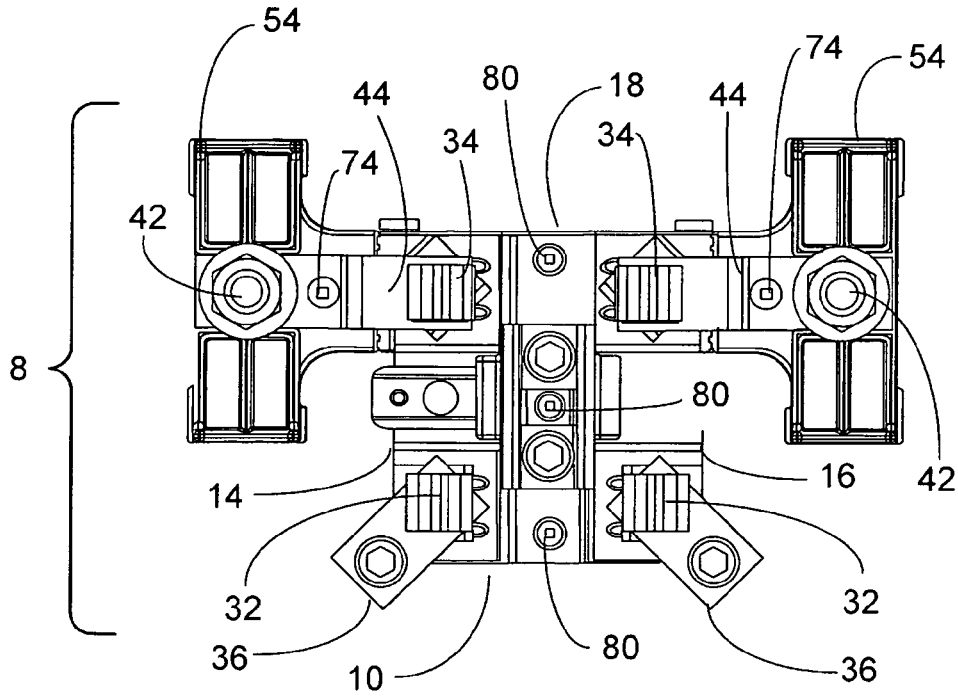
FIG. 14 is a top view of the meter socket assembly shown in FIG. 13.

FIGS. 13 and 14 show an end view and a top view of an embodiment of the meter socket assembly 8 with support blocks 54 attached to both sides of the mounting block 10. These views show how the support blocks 54 support the terminals 42 and electrical conductors 44. The cable connectors 36 are oriented at an angle of approximately 45-degrees from the centerline of the channel 18 that extends between the two side walls 14, 16 of the mounting block 10. FIG. 14 also shows how the meter jaws 32, 34 are configured to receive the blade contacts of a meter (not shown).

Figure 13A:
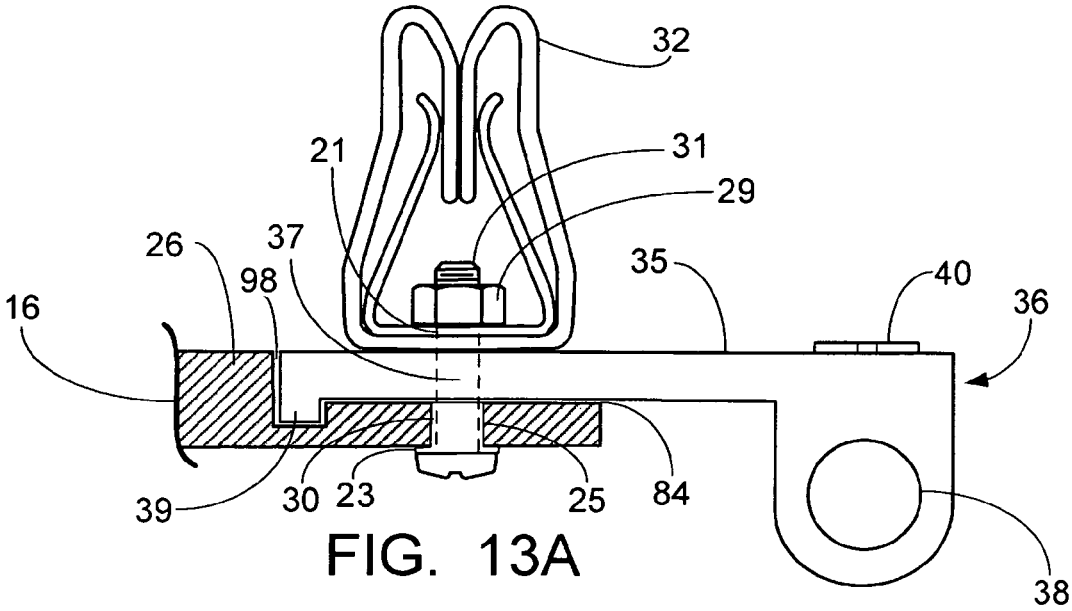
FIGS. 13A-C are details showing how the connector and meter jaws are attached to the mounting block, as well as a prior art device.

FIG. 13A is a detail showing how the meter jaw 32 and the connector 36 are attached to the mounting block 10 (FIG. 13) through the aperture 30 in the recessed portion 84. After the connector 36 is positioned in the recessed portion 84 with the lip 39 of the connector 36 in the slot 98, the first end of a cylindrically-shaped spacer 25 is inserted through the aperture 30 from the bottom of the mounting block 10. The second end of the spacer 25 has a flange 23 with a diameter greater than the diameter of the aperture 30, which prevents the spacer 25 from passing through the aperture 30. In some embodiments, the spacer 25 does not have a flange 25, but instead has two plain ends and the spacer 25 is retained in the aperture 30 by either a washer or the head of the threaded member 31. The threaded member 31 is inserted into the spacer 25 from the bottom of the mounting block 10 and the head of the threaded member 31 contacts the flange 23. The threaded end of the threaded member 31 passes through the spacer 25 and the aperture 37 in the connector 36 and is inserted through the aperture 21 in the base 27 of the meter jaw 32 (FIG. 12). The nut 29 is then threaded onto the end of the threaded member 31 and tightened to secure the meter jaw 32 and the connector 36 to the mounting block 10 (FIG. 13).

Figure 13B:
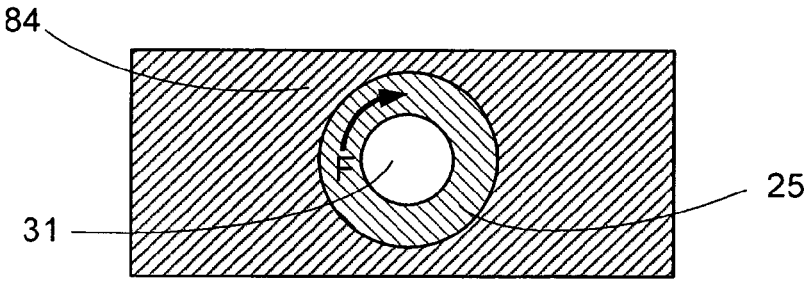

FIG. 13B shows a cross-sectional view of the spacer 25 and threaded member 31 passing through the recessed portion 84 of the mounting block 10. The threaded member 31 fits snugly into the spacer 25 and the spacer 25 fits snugly into the aperture 30 in the mounting block 10. However, the threaded member 31 can still freely rotate in the spacer 25 and the spacer 25 can freely rotate in the aperture 30. When the retaining screw 40 is tightened, the torque is transferred to the body 35 of the connector 36 and the threaded member 31 acts as a pivot point and transfers the force "F" to the lip 39 at the opposite end of the connector 36. The lip 39 then transfers the force to the slot 98 in the recessed portion 84 of the mounting block 10. This minimizes the force on the spacer 25 and the side wall of the aperture 30.

Figure 13C:
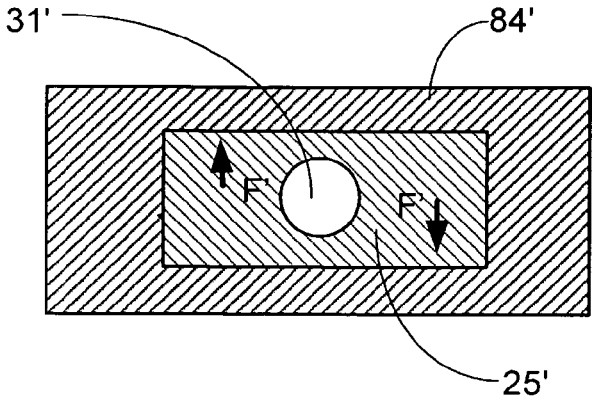
FIG. 13C PRIOR ART

FIG. 13C is a prior art U-shaped spacer 25' that is inserted into a rectangular opening in the block. The U-shaped spacer 25' has a pair of legs (not shown) that extend outwardly from the opposing ends of a rectangular base with an aperture for receiving a fastener, preferably a screw. The ends of the legs are wider than the opening in the block, which prevents the spacer 25' from passing all of the way through the rectangular opening. When a connector and meter jaw are attached to the block, the spacer 25' is inserted in the rectangular opening from the bottom (or back side) of the block and the tang (i.e., the flat, rectangular body) of the connector is placed on the top side of the spacer 25', and the base of a meter jaw is placed on top of the tang. A screw is then inserted from the bottom of the block through the spacer 25' and the apertures in the tang and the base of the meter jaw and secured in place by a nut threaded onto the screw. This creates a "sandwich" with the spacer 25', connector, and meter jaw held together by the head of the screw and the nut. The legs of the spacer 25' extend beyond the rectangular opening and contact one side of the block and the connector contacts the opposite side so that the assembly is retained in the block.

When a cable is installed in the port of the connector and the retaining screw is tightened, torque resulting from the tightening is transferred to the body of the connector and then to the rectangular spacer 25' causing it to move in the rectangular hole of the block. The torque created when the retaining screw is tightened is transferred to the body of the connector as a planar force. The planar force F' on the connector can eventually result in the rectangular spacer shearing the connector from the block. The design shown in FIG. 13B prevents the planar forces F from damaging the block 10 by providing a tight fit between the spacer 25 and the aperture 30 in the wall of the block 10 and transferring the force F from the spacer 25 to the slot 98 in the recessed portion of the mounting block 10. The round spacer 25 pivotably transfers the torque exerted on the retaining screw 40 to the opposite end of the connector 36 where it is transferred to the slot 98. In contrast, the rectangular spacers 25' used in the prior art transferred the forces F' to the rectangular opening in the block. If the rectangular spacer is designed to fit tightly in the rectangular opening, the force of the spacer against the plastic would tend to shear the plastic block and severely damage the block.

FIG. 15 shows a top view of a meter socket assembly 8 attached to the back wall of an enclosure 99. The meter socket assembly 8 includes a mounting block 10, a pair of support blocks 54, a neutral conductor connector 66, connectors 36, terminals 42 and meter jaws 32, 34 for receiving the blade contacts of a meter (not shown). Typically, wires and/or cables (not shown) enter the enclosure 99 through openings 97 in the back or side walls.

Figure 16:
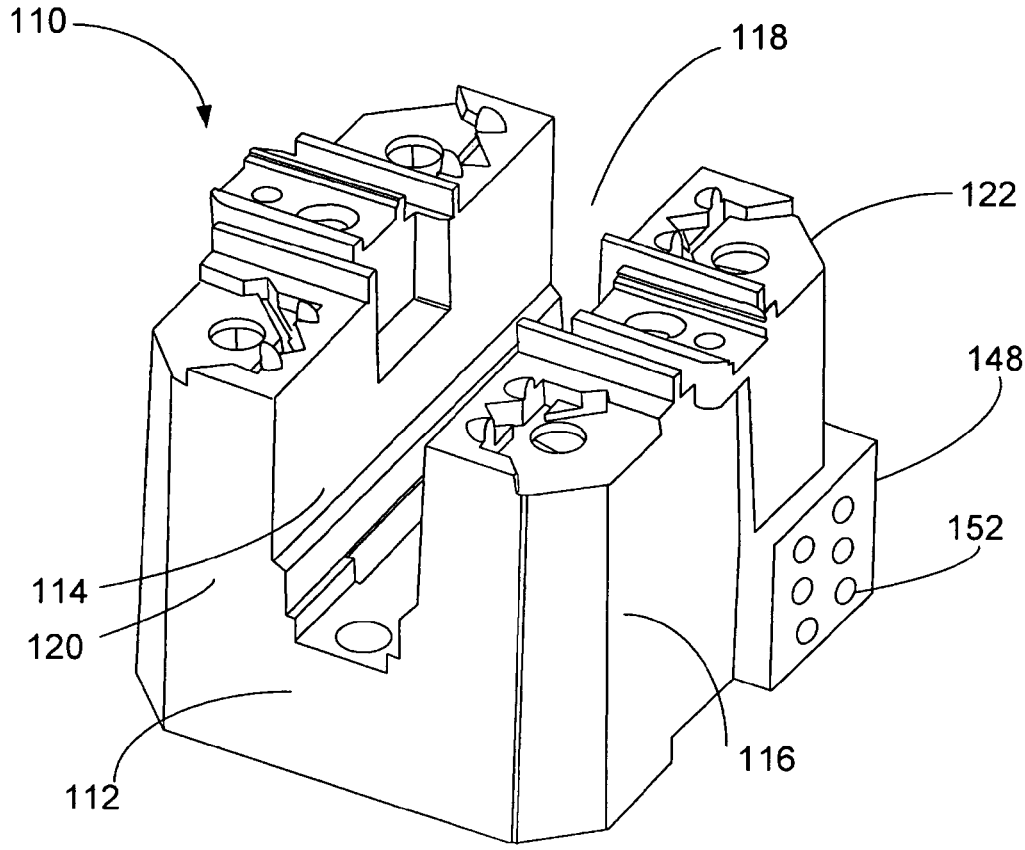
FIG. 16 is a top perspective view of a second embodiment of a mounting block of the meter socket assembly of the present invention.
Figure 17:
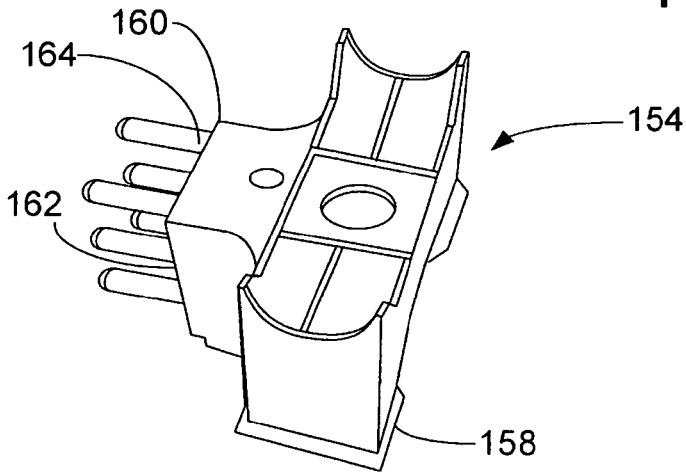
FIG. 17 is a top perspective view of a second embodiment of a support block of the meter socket assembly of the present invention.

FIG. 16 shows another embodiment of the mounting block 110 having a base 112, two walls 114, 116 defining a channel 118 and opposing ends 120, 122. The coupling mechanism 148 on the exterior side of one of the walls 116 is formed by a plurality of apertures. FIG. 17 shows a support block 154 with a first side 158 and a second side 160. A coupling mechanism 162 on the second side 160 is formed by a plurality of members 164 that extend outwardly. The members 164 are inserted into the apertures 152 in the mounting block 110 to connect the support block 154 to the mounting block 110.

Thus, while there have been described the preferred embodiments of the present invention, those skilled in the art will realize that other embodiments can be made without departing from the spirit of the invention, and it is intended to include all such further modifications and changes as come within the true scope of the claims set forth herein.

We claim:

1. A meter socket base assembly comprising:

a mounting block having first and second ends, first and second sides and a longitudinal axis between the first and second ends and comprising:

a base having a top and first and second sides, wherein the first and second sides correspond with the first and second sides of the mounting block;

first and second walls extending from the top of the base on the first and second sides, wherein the first and second walls are substantially parallel to the longitudinal axis and each has a top surface, a pair of opposing ends and interior and exterior sides, and wherein the top surface at each opposing end has a recessed portion with at least one substantially round opening extending through the top surface and one or more indentations;

a channel having a bottom formed by the base, wherein the channel is disposed between the interior sides of the first and second walls and extends between the first and second ends of the mounting block; and first and second coupling mechanisms formed in or on the exterior side of the first and second walls, respectively;

one or more connectors, each connector constructed of electrically conductive material and having a substantially planar body with a first end, a mid-portion and a second end, wherein the first end has a cable receiving port, the mid-portion has an aperture and the second end has a member that extends substantially perpendicular to the body, and wherein the member is adapted to be received by one of the indentations in one of the recessed portions;

one or more meter jaws, each meter jaw constructed of electrically conductive material and having a first end adapted to receive a blade contact of a meter and a second end with an aperture adapted for attachment of the meter jaw to one of the connectors and the mounting block; and at least one support block, wherein the support block comprises an electrical terminal and has a top, a bottom, a pair of sides, a pair of ends and a coupling mechanism in or extending from one of the sides, wherein the coupling mechanism is adapted to be coupled with one of the coupling mechanisms on the mounting block to attach the support block to the mounting block.

2. The meter socket base assembly according to claim 1, wherein the mounting block and the at least one support block are formed from electrically non-conductive material.

3. The meter socket base assembly according to claim 1, wherein the electrical terminal on the at least one support blocks is connected to one of the meter jaws by an electrical conductor.

4. The meter socket base assembly according to claim 1, wherein at least one of the one or more indentations in each of the recessed portions is a slot and the member on at least one of the one or more connectors is a lip extending along the second end of the connector.

5. The meter socket base assembly according to claim 4, wherein each of the recessed portions has first and second slots, wherein the first slot extends substantially perpendicular to the longitudinal axis of the base and the second slot extends at about a 45-degree angle to the longitudinal axis.

6. The meter socket base assembly according to claim 1, wherein the first and/or second coupling mechanism of the mounting block comprises one or more slots, wherein the coupling mechanism of the at least one support block comprises one or more rails, and wherein the rails engage the slots to couple the at least one support block to the mounting block.

7. The meter socket base assembly according to claim 1 further comprising at least one threaded member, at least one spacer and at least one nut, wherein the at least one spacer is inserted in the at least one opening in one of the recessed portions and the threaded member is sequentially inserted through the at least one spacer, the aperture in one of the connectors and the aperture in one of the meter jaws and the nut is threaded onto the threaded member to secure the connector and the meter jaw to the mounting block.

8. The meter socket base assembly according to claim 7, wherein each of the one or more connectors further comprises a retaining screw adapted to secure a cable in the cable receiving port and wherein the spacer is cylindrically shaped and adapted to transfer a force created by tightening the retaining screw on the first end of the body to the member on the second end and then to the indentations in one of the recessed portions.

9. The meter socket base assembly according to claim 1, wherein the first and/or second coupling mechanism of the mounting block comprises one or more rails, wherein the coupling mechanism of the at least one support block comprises one or more slots, and wherein the rails engage the slots to couple the at least one support block to the mounting block.

10. The meter socket base assembly according to claim 1, wherein the first and/or second coupling mechanism of the mounting block comprises one or more apertures, wherein the coupling mechanism of the at least one support block comprises one or more members extending from the wall, and wherein the members engage the apertures to couple the at least one support block to the mounting block.

11. The meter socket base assembly according to claim 1, wherein the first and/or second coupling mechanism of the mounting block comprises one or more members extending from the wall, wherein the coupling mechanism of each of the one or more support blocks comprises one or more apertures, and wherein the members engage the apertures to couple the at least one support block to the mounting block.

12. The meter socket base assembly according to claim 1, wherein the channel is adapted for receiving an insulated neutral conductor.

13. The meter socket base assembly according to claim 1, wherein the channel further comprises one or more apertures in the bottom, and wherein each aperture is adapted for receiving a screw to attach the mounting block to a surface.

14. The meter socket base assembly according to claim 1, wherein the ends of the first and second walls of the mounting block are hollow.

15. The meter socket base assembly according to claim 14, wherein a fastening device is inserted through one of the hollow ends to attached one of the one or more meter jaws to the mounting block.

16. The meter socket base assembly according to claim 1, further comprising a connector for a neutral conductor.

17. The meter socket base assembly according to claim 1, wherein the at least one support block further comprises one or more apertures, and wherein each aperture is adapted for receiving a screw to attach the at least one support block to a surface.

18. A meter socket base assembly comprising:

a mounting block having first and second ends, first and second sides and a longitudinal axis between the first and second ends and comprising:

a base having a top and first and second sides, wherein the first and second sides correspond with the first and second sides of the mounting block;

first and second walls extending from the top of the base on the first and second sides, wherein the first and second walls are substantially parallel to the longitudinal axis and each has a top surface, a pair of opposing ends and interior and exterior sides;

a channel having a bottom formed by the base, wherein the channel is disposed between the interior sides of the first and second walls and extends between the first and second ends of the mounting block; and first and second coupling mechanisms in or on the exterior side of the first and second walls, respectively, wherein the coupling mechanisms are one or more slots, one or more rails, one or more apertures or one or more members; and at least one support block, wherein the support block comprises an electrical terminal and has a top, a bottom, a pair of sides, a pair of ends and a coupling mechanism in or extending from one of the sides, wherein the coupling mechanism is one or more slots, one more rails, one or more apertures or one or more members, and wherein the coupling mechanism of the at least one support block is adapted to be coupled with one of the coupling mechanisms on the mounting block to attach the at least one support block to the mounting block.

19. The meter socket base assembly according to claim 18, wherein the mounting block and the at least one support block are formed from electrically non-conductive material.

20. The meter socket base assembly according to claim 18, wherein the ends of the first and second walls of the mounting block are hollow.

21. The meter socket base assembly according to claim 18, wherein the channel further comprises one or more apertures in the bottom, and wherein each aperture is adapted for receiving a screw to attach the mounting block to a surface, and wherein the at least one support block further comprises at least one aperture adapted for receiving a screw to attach the at least one support block to a surface.

22. A meter socket base assembly comprising:

a mounting block having first and second ends, first and second sides and a longitudinal axis between the first and second ends and comprising:

a base having a top and first and second sides, wherein the first and second sides correspond with the first and second sides of the mounting block;

first and second walls extending from the top of the base on the first and second sides, wherein the first and second walls are substantially parallel to the longitudinal axis and each has a top surface, a pair of opposing ends and interior and exterior sides, and wherein the top surface at each opposing end has a recessed portion with at least one substantially round opening extending through the top surface and one or more indentations; and a channel having a bottom formed by the base, wherein the channel is disposed between the interior sides of the first and second walls and extends between the first and second ends of the mounting block;

one or more connectors, each connector constructed of electrically conductive material and having a substantially planar body with a first end, a mid-portion and a second end, wherein the first end has a port for connecting a cable, the mid-portion has an aperture and the second end has a member that extends substantially perpendicular to the body, and wherein the member is adapted to be received by one of the indentations in one of the recessed portions; and one or more meter jaws, each meter jaw constructed of electrically conductive material and having a first end adapted to receive a blade contact of a meter and a second end with an aperture adapted for attachment of the meter jaw to one of the connectors and the mounting block.

23. The meter socket base assembly according to claim 22, wherein the mounting block is formed from electrically non-conductive material.

24. The meter socket base assembly according to claim 22, wherein at least one of the one or more indentations in each of the recessed portions is a slot and the member on at least one of the one or more connectors is a lip extending along the second end of the connector.

25. The meter socket base assembly according to claim 24, wherein each of the recessed portions has first and second slots, wherein the first slot extends substantially perpendicular to the longitudinal axis of the base and the second slot extends at about a 45-degree angle to the longitudinal axis.

26. The meter socket base assembly according to claim 22 further comprising at least one threaded member, at least one spacer and at least one nut, wherein the at least one spacer is inserted in the at least one opening in one of the recessed portions and the threaded member is sequentially inserted through the at least one spacer, the aperture in one of the connectors and the aperture in one of the meter jaws and the nut is threaded onto the threaded member to secure the connector and the meter jaw to the mounting block.

27. The meter socket base assembly according to claim 26, wherein each of the one or more connectors further comprises a retaining screw adapted to secure a cable in the cable receiving port and wherein the spacer is cylindrically shaped and adapted to transfer a force created by tightening the retaining screw on the first end of the body to the member on the second end and then to the indentations in one of the recessed portions.

28. The meter socket base assembly according to claim 22, wherein the channel further comprises one or more apertures in the bottom, and wherein each aperture is adapted for receiving a screw to attach the mounting block to a surface.

29. The meter socket base assembly according to claim 22, wherein the ends of the first and second walls of the mounting block are hollow.

30. The meter socket base assembly according to claim 29, wherein a fastening device is attached to one of the meter jaws through one of the hollow ends to secure the meter jaw to the mounting block.

31. The meter socket base assembly according to claim 22, wherein at least one of the one or more meter jaws is attached to the mounting block with a threaded member and a nut.

* * * * *